US005259612A

United States Patent [19]

Matherne et al.

[11] Patent Number: 5,259,612

[45] Date of Patent: Nov. 9, 1993

[54] PORTABLE SUPPORT FOR A BASKETBALL GOAL SYSTEM

[75] Inventors: Lonny R. Matherne, Pleasant View; Elmo V. Rhoton, Fruit Heights; Barry D. Mower, Layton, all of Utah

[73] Assignee: Lifetime Products, Inc., Clearfield, Utah

[21] Appl. No.: 941,989

[22] Filed: Sep. 8, 1992

Related U.S. Application Data

[63] Continuation-in-part of Ser. No. 829,467, Jan. 31, 1992.

[51] Int. Cl.[5] ..... A63B 63/08

[52] U.S. Cl. ..... 273/1.5 R; 248/514; 248/910; 220/375; 403/88

[58] Field of Search ..... 273/1.5 R, 1.5 A; 248/514, 520, 515, 230, 910; 220/375; 403/85, 88, 73

[56] References Cited

U.S. PATENT DOCUMENTS

| | | | |
|---|---|---|---|
| 193,015 | 7/1877 | McCarthy | 220/375 X |
| 419,137 | 1/1890 | Bobemerith | 248/515 |
| 589,261 | 8/1897 | Koch et al. | 248/230 X |
| 650,211 | 5/1900 | Wirth | 248/230 |
| 1,310,323 | 7/1919 | Centolella | 248/230 |
| 2,898,065 | 8/1959 | Ackley | 248/515 |
| 2,930,559 | 3/1960 | Lohr | 248/515 |
| 3,094,303 | 6/1963 | Belger | 248/514 |
| 3,731,897 | 5/1973 | Price | 248/230 |
| 3,854,168 | 12/1974 | Bradley | 248/514 X |
| 4,017,998 | 4/1977 | Dumler | 248/514 X |
| 4,307,864 | 12/1981 | Benoit | 248/230 X |
| 4,842,152 | 6/1989 | Donegan | 220/375 X |
| 5,165,565 | 11/1992 | Schlessmann et al. | 220/375 X |
| 5,191,852 | 3/1993 | Rupp | 248/520 X |

FOREIGN PATENT DOCUMENTS

| | | | |
|---|---|---|---|
| 544020 | 6/1922 | France | 248/514 |
| 755442 | 9/1933 | France | 403/85 |

*Primary Examiner*—Paul E. Shapiro

*Attorney, Agent, or Firm*—Madson & Metcalf

[57] ABSTRACT

A portable water-filled device for supporting a basketball system including a base configured to hold a ballast material for supporting the basketball system in a substantially rigid position during us of the system to play the game of basketball. A pole is pivotally mounted to the base such that the pole may move between a generally vertical position and a tilted position with the base configured with a beveled hole for restraining the pole from pivotal movement substantially beyond the tilted position. A contractible sleeve is utilized to pivotally attach support arms to the pole. The sleeve includes an adjustment wheel for securing the sleeve to the pole and a bubble level for vertically positioning the pole. The base is configured with an orifice through which water may be inserted into the base. A plug for closing the orifice includes an anchor for loosely connecting the plug to the base when the plug is disengaged from the orifice.

14 Claims, 9 Drawing Sheets

PORTABLE SUPPORT FOR A BASKETBALL GOAL SYSTEM

RELATED U.S. APPLICATION

This application is a continuation in part of application Ser. No. 07/829,467, filed Jan. 31, 1992 and entitled PORTABLE WATER-FILLED BASE FOR A BASKETBALL GOAL SYSTEM.

BACKGROUND

1. The Field of the Invention

The present invention is related to a portable support system for a basketball goal assembly. More particularly, the present invention is related to a portable water-filled base for use in supporting a basketball goal system employing a unique design enabling it to be moved when filled with water.

2. Technical Background

As the game of basketball has increased in popularity, a greater number of people have purchased basketball goals for use at their homes. Such goals are typically permanently mounted such that the driveway of the home serves as the basketball court, as few homes have sufficient land surrounding the home to dedicate space for exclusive use as a basketball court.

In some instances, locating where to mount a basketball goal can pose some difficulties. For example, at some homes, permanently mounting a basketball goal next to the driveway could provide a risk to traffic in the driveway, resulting in danger or damage to both automobiles and the goal system.

In some cases, the only viable location for mounting a basketball goal is in a location where permanently mounting a goal cannot be easily accomplished. Such a location may be where there is concrete or asphalt on the ground; thus, to mount the goal would require breaking a hole in the concrete or asphalt and then repairing the hole after the pole has been affixed in the ground. Such a procedure could be expensive and would most likely leave the driveway appearing unsightly.

Permanently installed outdoor basketball goals suffer from other disadvantages as well. Because they are permanently mounted, they are generally exposed to the weather throughout the entire year. Constant exposure to the weather can cause the goal system to prematurely wear by promoting oxidation. Premature oxidation can be particularly troublesome in goals having moving parts, such as goals that employ adjustable height or breakaway goal mechanisms. Constant exposure to the weather can cause these mechanisms to prematurely fail.

Even permanently mounted basketball goals utilized in indoor environments suffer from some disadvantages. For example, a typical school has a gymnasium which must serve many purposes. Having several basketball goals permanently mounted for use in the gymnasium may preclude or at least interfere with certain other activities. On formal occasions, objection may be made to the appearance of permanently mounted basketball goals.

In response to these and other disadvantages inherent in permanently mounted basketball goals, some designs of portable basketball goals have been developed. In order for a portable goal to be effective, sufficient weight must be employed to maintain the goal in a generally rigid position for use in playing the game of basketball. Hence, some portable designs utilize a great deal of weight, making the goals particularly difficult to move and possibly requiring the assistance of several people to set up or remove the goal. Additionally, such designs can be prohibitively expensive for people desiring to purchase one for use at their home.

Some prior-art designs have utilized removable weights, such as sand bags or metal weights, for use on the support structure. A principal disadvantage to the use of these types of removable weights is that they can be extremely heavy. While the support and the goal systems employing such designs may be easier to move, the weights are not. Some such designs, in an attempt to minimize the amount of removable weights required, are extremely large and bulky because they employ long lever arms in order to increase the effective weight of the removable weights.

In an attempt to make a portable basketball goal that would be ideal for use at home, some designs have employed a water-filled base. Such goals can be easily moved to a desired location where the base is then filled with water, thereby providing sufficient weight to maintain the goal in a generally rigid position for use in playing basketball. When it is desired to move the goal, the water is emptied out and the goal moved. The principal advantage of such a goal is in the use of water. Water is inexpensive, plentiful and convenient to use.

Such water-filled goal designs do suffer from some disadvantages, however. Having to fill and empty the goal each time the goal is to be set up or moved requires time and is an inconvenience. This procedure is particularly difficult if the goal is being used indoors.

Additionally, because water has a density of approximately 8.3 pounds per gallon, several gallons of water are required to effectively support the goal in a generally rigid position. Thus, when emptying the water out of the goal, precautions have to be taken to ensure that the water is properly directed so it does not cause damage to the home or other surroundings. Also, the utilization of a water-filled base presents the hazard that the base receptacle or container aspect could be broken if the water within the base freezes and expands.

An almost universal disadvantage to the use of any portable basketball goal is that they are difficult to store. A standard height basketball goal is ten feet high, with the backboard extending upwardly approximately two more feet. Few people have garages or storage sheds that will accommodate an apparatus that is 12 feet high. Thus, such portable goals are usually stored in a horizontal position. Of course, storing a basketball goal system in a horizontal position takes up substantial floor space. Some garages or storage sheds do not have sufficient floor space to store a goal, forcing the owner to store the goal outside, thereby eliminating some of the advantages of the portable goal system.

A design flaw associated with some portable goal systems is that the pole onto which the backboard and goal assembly is secured is disposed at an angle. This is generally done to provide sufficient horizontal distance between the base, which generally extends outwardly in all directions from the pole, and the backboard. If someone wants to retrofit this portable base and pole for use with a backboard and goal they already own, it could be difficult to mount the backboard and goal assembly to a pole disposed at an angle.

Most basketball goals are designed to be secured to a vertical surface. For example, most adjustable goal systems, such as those disclosed and claimed in U.S. Pat. Nos. 4,781,375 and 4,805,904, require a vertical mounting surface. Of course, adapters may be employed, but they would unduly add to the cost and complexity of the system.

Thus, it would be an advancement in the art to provide a portable support for a basketball goal system which utilizes water as a weight, but which can be easily moved by one person without having to drain the water out of the support.

It would also be an advancement in the art to provide a portable support for a basketball goal system which would permit the maximum vertical height of the basketball goal system to be decreased for storage purposes, thereby permitting the goal system to be stored in a generally upright position and facilitating storage of the system in a garage or storage shed.

Indeed, it would be an additional advancement in the art to provide such a support for a basketball system to which a pole could be connected such that the pole is disposed in a substantially vertical position, thereby providing a vertical support to which could be attached a backboard and goal assembly.

Such a device is disclosed and claimed herein.

BRIEF SUMMARY AND OBJECTS OF THE INVENTION

The present invention is directed to a portable, water-filled device for supporting a basketball system. In one embodiment, the support includes a base configured with an interior cavity for holding a predetermined amount of ballast material, such as water. A pole is pivotally connected to the base at the proximal end of the base such that the pole may move between a generally vertical position and a tilted position. In its generally vertical position, a backboard and goal assembly connected to the pole are also disposed in a substantially vertical position, directed away from the base.

Support arms are pivotally connected to the base at the distal end of the base and extend diagonally to the pole where they are secured to the pole with a slidable, contractible collar. Thus, as the pole moves from its generally vertical position to its tilted position, the support arms provide support to the pole, thereby permitting the goal system to maintain its generally upright position while reducing the total vertical height of the system.

The support arms are attached to the collar with a bolt which extends through flanges configured in the collar. Rotation of the bolt relative to the collar is prevented by disposing the head of the bolt within a bolt-head retainer molded within the collar.

The nut of the bolt is disposed within a nut retainer configured within an adjustment wheel, thereby facilitating the tightening or loosening of the nut. The adjustment wheel is further configured with a plurality of radial spokes which engage a tab extending outwardly from the collar. Thus, as the adjustment wheel is used to tighten the nut against the flanges, the tab emits a sharp noise. After the adjustment wheel has been sufficiently rotated to secure the collar to the pole, the tab may engage a spoke in the adjustment wheel to bias the adjustment wheel against rotation, such as may occur as a result of vibration of the pole.

The slidable collar is further configured with two bosses between which is mounted a bubble level. The bosses are positioned on the collar such that the bubble level will indicate when the pole to which the collar is attached is disposed in a vertical position.

The base is configured to hold a predetermined amount of water such that the weight of the water creates a sufficient moment about the proximal end of the base to counteract the moment resulting from the weight of the backboard and goal assembly about the proximal end of the base. The weight of the water also provides sufficient support to the goal system to maintain the system in a substantially rigid position during use of the goal system in playing basketball.

The base is designed such that the height and width of the cavity within the base generally increase towards the distal end of the base. The effect of this design is to place more water, and hence more weight, further from the proximal end of the base and thereby provide greater stability to the goal system.

The base is provided with skid plates on its bottom to provide a frictional surface on the base for resting against the ground or other support surface upon which the goal system is being used.

The goal system is moved by initially moving the pole into its tilted position and rotating the goal system about the distal end of the base into a reclined position. A set of wheels are provided at the distal end of the base which come into contact with the ground upon rotation of the goal system into the reclined position. When the goal system is in its upright position, the wheels do not contact the ground.

Due to the configuration of the base referenced above, the center of gravity of the water-filled base is closer to the distal end than to the proximal end of the base. The center of gravity is closer to the distal end when the goal system is disposed in a tilted position. This enables the goal system to be easily rotated about the distal end of the base into the reclined position. In the reclined position, with the goal system supported upon the wheels, the system may be easily moved from one location to another.

The base is configured with a beveled hole for receiving the end of the pole. The beveled hole includes a vertical portion configured to receive the pole when the pole is in its generally vertical position. The beveled hole also includes a tilted portion configured to receive the pole when the pole is in its tilted position and which acts as a safety mechanism for preventing further pivotal movement of the pole beyond the tilted position.

The base includes an orifice through which water may be inserted into the base. The orifice is positioned near, but spaced from, the top portion of the base such that when the base is filled with water to the point that the water level in the base reaches the orifice, a void remains within the top of the cavity which does not fill with water. This void is of sufficient volume that if the water within the base were to freeze, there would be sufficient room within the cavity for the resulting expansion. Thus, the base would not be damaged in the event water within the base freezes.

A plug is provided for closing the orifice. The plug is provided with an anchor which extends into the base and is configured to engage the base upon withdrawal of the plug from the orifice, thereby loosely connecting the plug to the base when the plug is disengaged from the orifice and preventing the plug from becoming separated from the base and misplaced.

Thus, it is an object of the present invention to provide a portable, water-filled support for use in supporting a basketball goal system which can be easily moved from one location to another without removing the water from the support.

It is an additional object of the present invention to provide such a portable, water-filled support for a basketball goal system which could be used to decrease the maximum vertical height of the basketball goal system for storage purposes, thereby permitting the goal system to be stored in an upright position and facilitating storage of the system in a garage or storage shed.

A further object of the present invention is to provide such a support to which a pole may be attached such that it is disposed in a substantially vertical position, thereby providing a vertical support to which could be attached a backboard and goal assembly.

These and other objects and advantages of the present invention will become more fully apparent by examination of the following description of the preferred embodiments and the accompanying drawings.

DESCRIPTION OF THE PREFERRED EMBODIMENTS

Figure 1:
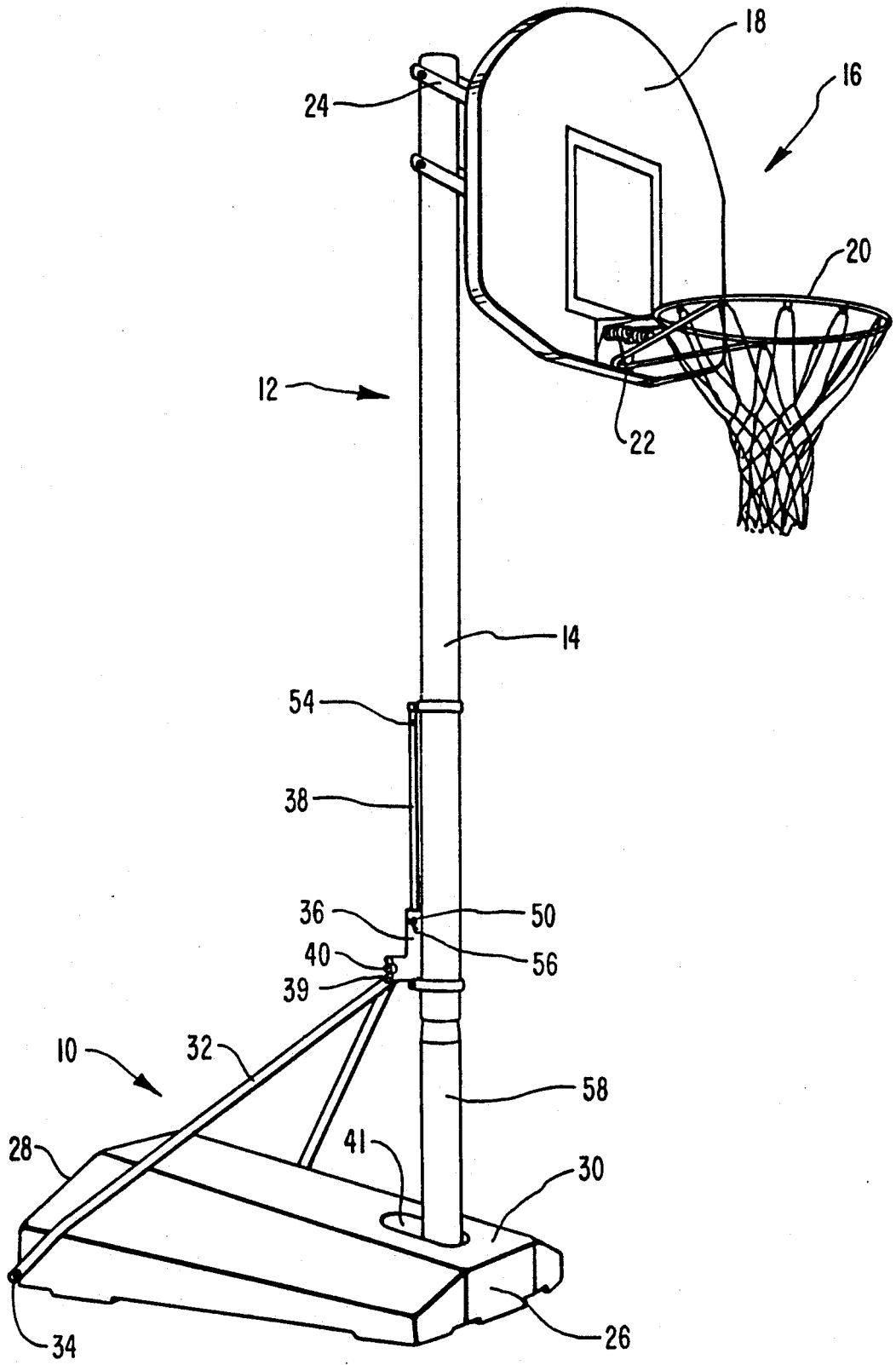
FIG. 1 is a perspective view of one embodiment of the portable, water-filled support of the present invention as it would appear with a pole and backboard and goal assembly attached thereto.

Reference is now made to the figures wherein like parts are referred to by like numerals throughout. With particular reference to FIG. 1, a portable, water-filled support according to the present invention is generally designated at 10. To the support 10 is connected a basketball goal system 12 comprising a pole 14 and a backboard and goal assembly 16. The backboard and goal assembly 16 may include a backboard 18, a rim 20, a rim mounting mechanism 22 and a backboard attachment assembly 24.

The backboard and goal assembly 16 may include any of those components conventionally known and used in playing the game of basketball. In particular, the rim mounting mechanism may include a break-away mounting mechanism such as that disclosed and claimed in U.S. Pat. No. 4,846,469. The backboard attachment assembly may include such assemblies used in connection with adjustable goal systems such as those disclosed and claimed in U.S. Pat. Nos. 4,781,375 and 4,805,904.

The water-filled support 10 includes a base 30. In a presently preferred embodiment of the invention, the base 30 is made of a low-density linear polyethylene, although it will be appreciated that a variety of materials could be employed. The base 30 is preferably molded with structural ribs 31 (see FIGS. 2 and 5) in the bottom of the base to decrease deformation, or "sagging," of the bottom of the base under the weight of the water. In a presently preferred embodiment, the ribs 31 extend longitudinally in the base between the proximal end 26 and the distal end 28 of the base.

The pole 14 is attached to the base at its proximal end 26. At the opposite, or distal, end 28 of the base 30 is pivotally attached a pair of support arms 32 at axles 34 disposed on each side of the distal end 28. The upper end of each support arm 32 is pivotally attached to a sleeve 36 which is disposed for sliding engagement along a shaft 38. A nut 39 and a bolt 40 are employed to attach the support arms 32 pivotally to the sleeve 36, although any suitable type of pivotal connection can be used.

As viewed in FIGS. 1 through 4, the base is configured with a beveled hole 41 at its proximal end through which a pole segment 58 extends for attachment to the base 30. The beveled hole 41 is configured to accommodate movement of the pole 14 as it moves between a substantially vertical position and a tilted position, as best viewed in FIG. 4.

Figure 9:
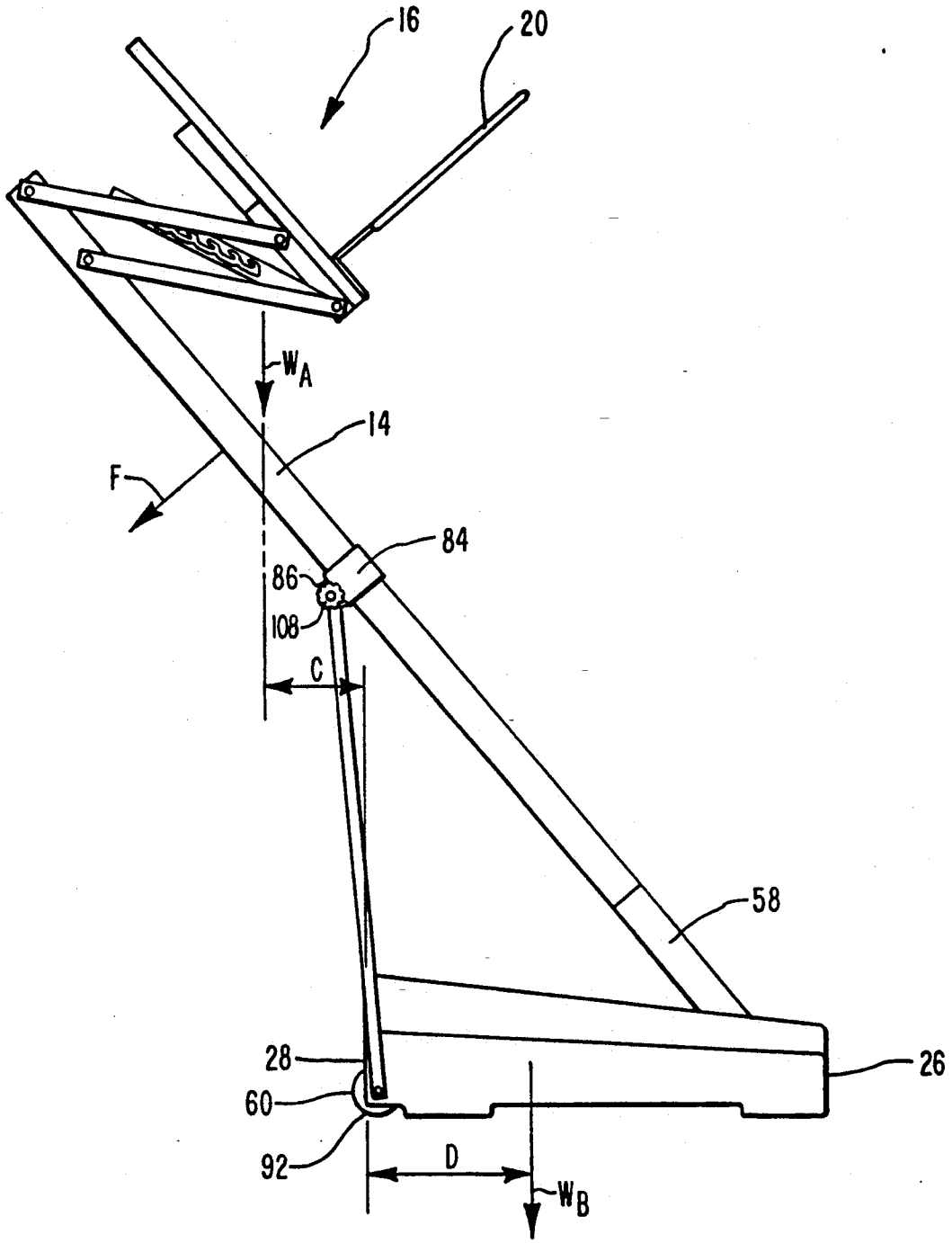
FIG. 9 is a side view of the embodiment of the present invention illustrated in FIG. 8, but with the pole in its tilted position showing lower vertical height.

The pole mounting segment 58 is preferably a cylindrical section having generally the same circumferential dimensions as the pole 14. The pole mounting segment 58 is pivotally connected to the base 30 between two flanges 44 located on each side of the beveled hole 41. A fastener 46 extends through the pole mounting segment 58 and the flanges 44 to provide an axis of rotation for the pole mounting segment 58. Such pivotal attachment about fastener 46, enables the pole 14 to be rotated between a generally vertical position, as illustrated in FIG. 1, and a tilted position as illustrated by the phantom lines of FIG. 4 and as shown in FIG. 9.

The beveled hole 41 includes a vertical portion 42 configured to restrain the pole 14 when the pole 14 is in its generally vertical position. The beveled hole 41 also includes a tilted portion 43 configure to restrain the pole 14 when the pole 14 is in its tilted position. The beveled hole 41 acts as a safety mechanism for preventing further pivotal movement of the pole 14 substantially beyond the tilted position. If one were to release the sleeve 36 and permit the goal to rotate freely under the force of its own weight, the beveled hole 41 would act as a stop when the pole 14 reaches the tilted position, thereby preventing the goal from crashing to the ground or tilting to an unstable configuration.

The pole 14 is attached to the pole mounting segment 58 by any of a variety of means known in the art for rigidly combining two cylindrical pieces. These methods may include utilizing the permanent fastener-free joint disclosed and claimed in U.S. patent application Ser. No. 07/421,584. In lieu of utilizing a pole mounting segment 58, the pole 14 may be a one-piece pole such as those conventionally known for use in supporting a basketball goal system. If a one-piece pole is employed, the pole 14 itself would be pivotally connected to the base 30 between the flanges 44 located on each side of the beveled hole 41 with fastener 46 extending through the pole 14 to provide an axis of rotation for the pole 14.

Figure 2:
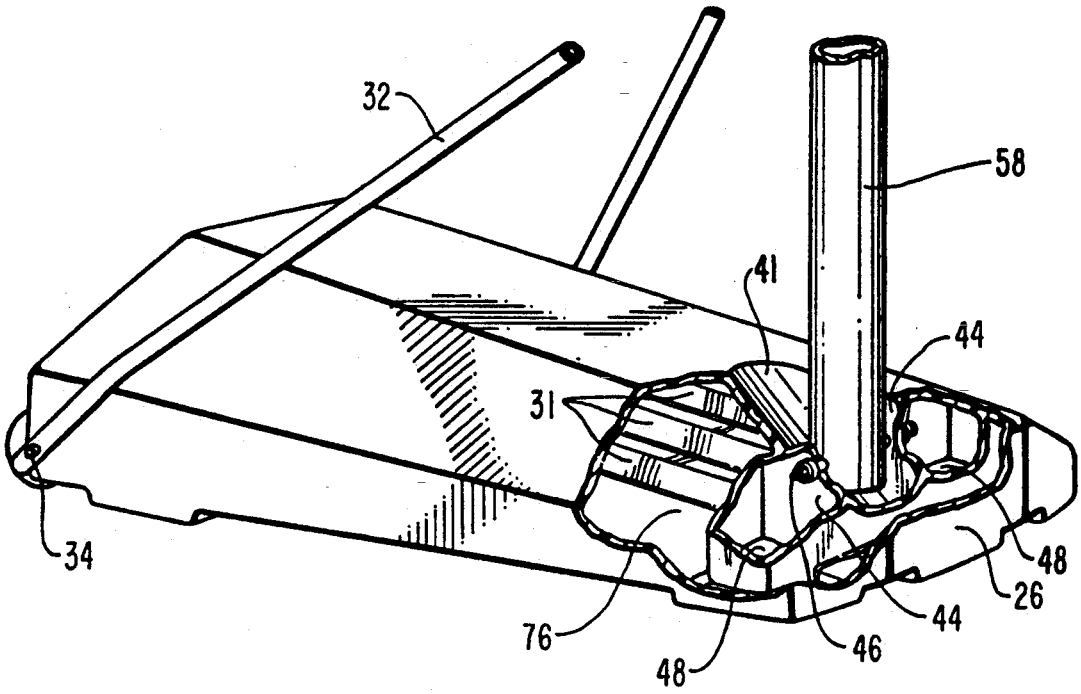
FIG. 2 is a perspective view of the base of the support of FIG. 1, with portions broken away to illustrate internal features of the base.
Figure 5:
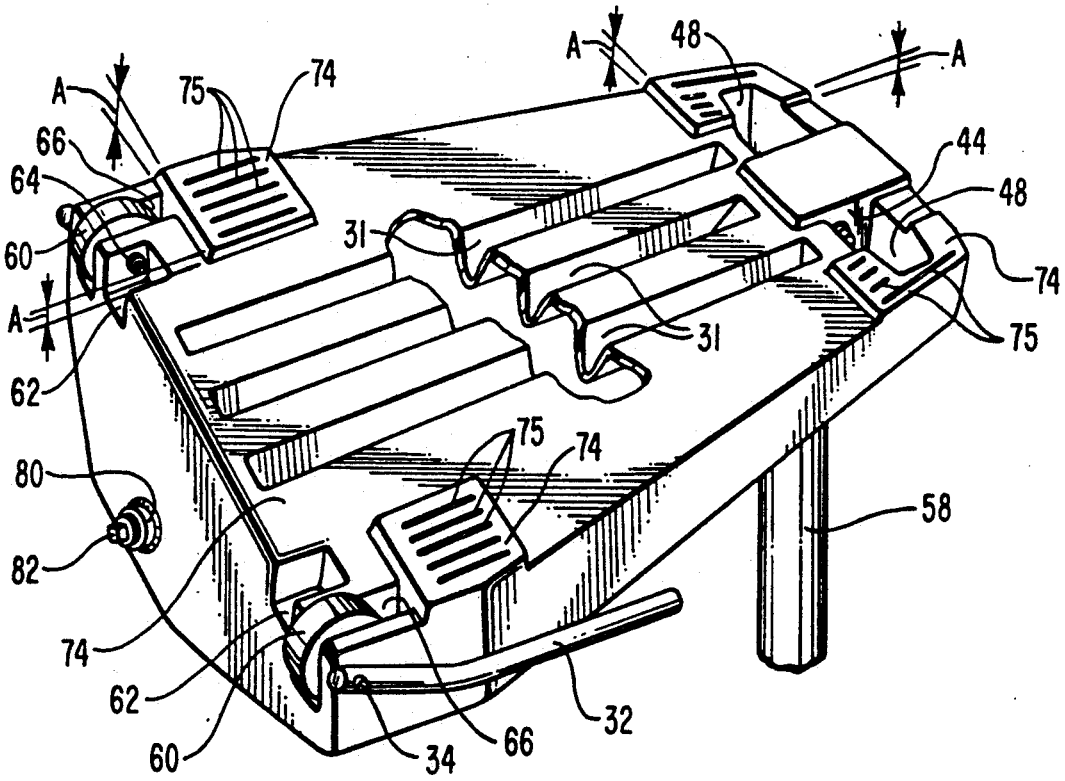
FIG. 5 is a perspective view of the bottom of the base of the support of FIG. 1 illustrating the skid plates.

The base 30 is further configured with a void 48 on each side of the flanges 44 to provide access to the fastener 46, as seen best in FIGS. 2 and 5.

The sleeve 36 contains a locking hole 50 which corresponds to and is alignable with lower hole 52 (FIG. 13) and upper hole 54 (FIG. 1) located in the shaft 38. A pin 56 is employed to lock the sleeve 36 to the shaft 38. With the pole 14 in its generally vertical position, the pin 56 is inserted through locking hole 50 on the sleeve 36 and through lower hole 52, thereby preventing relative movement between the sleeve 36 and the shaft 38 and locking the pole 14 in its generally vertical position. With the pole 14 in its tilted position, the locking hole 50 is aligned with the upper hole 54 and the pin 56 is utilized to lock the pole 14 in the tilted position by inserting the pin 56 through the aligned holes.

A presently preferred apparatus for attaching the support arms 32 to the pole 14 is illustrated in FIGS. 8 through 12. A contractible collar 84 is employed which extends around the pole 14. Flanges 86 are configured into the collar 84 between which the ends of the support arms 32 are held. A fastener 88 such as a bolt 100 and a nut 102 may be employed to secure the flanges 86 and the ends of the support arms 32 together and to tighten the collar 84 around the pole 14, thereby locking the support arms 32 to the pole 14 in any desired position.

Figure 10:
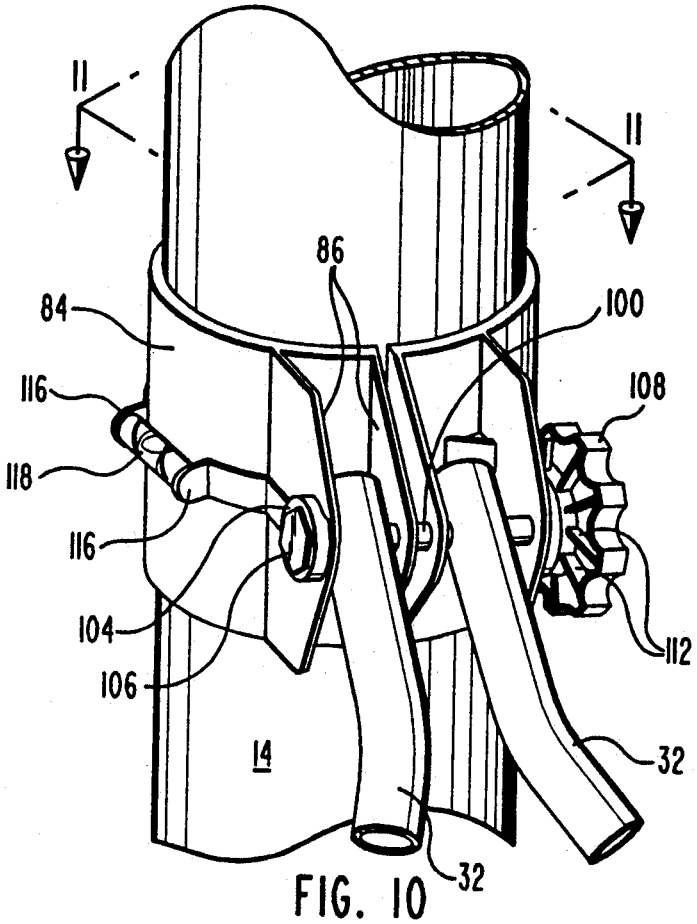
FIG. 10 is an enlarged perspective view of a preferred embodiment of an attachment assembly in accordance with the teachings of the present invention.

A presently preferred contractible collar 84 has a split configuration, as best viewed in FIG. 10, thereby allowing the circumference of the collar 84 to be adjusted. However, one of skill in the art will appreciate that other configurations may be utilized in constructing a contractible collar in accordance with the teachings of the present invention.

As viewed in FIG. 10, collar 84 is configured with a bolt-head retainer 104. Thus, rotation of bolt 104 relative to the slidable collar is prevented by disposing the head 106 of the bolt 100 within the bolt-head retainer 104. It has been found that manufacturing is facilitated if collar 84 is molded from high-density polyurethane with the bolt-head retainer 104 molded as part of the collar 84.

An adjustment wheel 108 is configured with a nut retainer 110 (FIG. 12) for receiving the nut 102 of the bolt 100. Adjustment wheel 108 is also preferably made of plastic and made in accordance with known plastic molding techniques. Adjustment wheel 108 provides the user with mechanical advantage for tightening or loosening nut 102 about bolt 100.

The adjustment wheel 108 is further configured with a plurality of radial spokes 112. A tab 114 (FIGS. 11 and 12) is molded onto one of the flanges 86 of the collar 84 and extends outwardly such that it engages the spokes 112 as the adjustment wheel 108 is used to tighten nut 102 about bolt 100. As the adjustment wheel 108 is used to tighten the nut 102, the radial spokes 112 engage the tab 114, causing it to deflect. As the wheel 108 continues to rotate, the tab 114 is disengaged from the spoke 112, emitting a sharp noise and thereby providing an audible indication of the rotation of adjustment wheel 108.

After the adjustment wheel 108 has been sufficiently rotated to secure the collar 84 to the pole 14, the tab 114 biases the adjustment wheel 108 to prevent the nut 102 from vibrating loose. If the nut 102 begins to rotate, such as could occur if the system is subject to vibration, the tab 114 will engage a spoke 112 and prevent further rotation of the wheel 108 by applying a biasing force against the spoke 112 which must be overcome before further rotation of the wheel 108 can take place. Generally, any vibrational forces acting on the system do not result in a rotational force of sufficient magnitude to overcome the biasing force of the tab 114 acting on the spoke 112.

Figure 11:
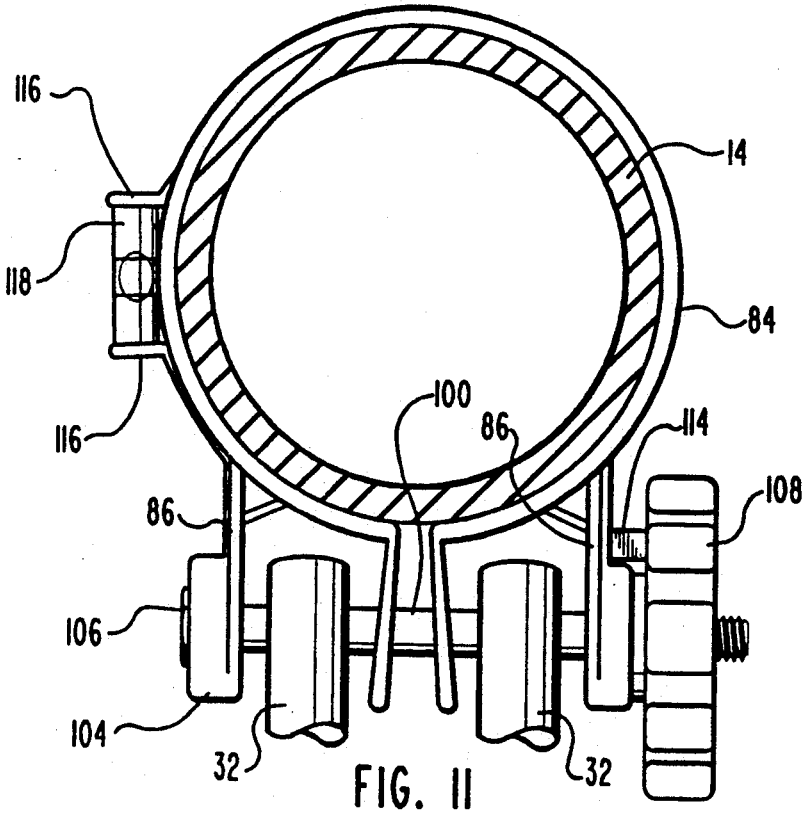
FIG. 11 is a cross-sectional view taken along line 11—11 of FIG. 10.
Figure 12:
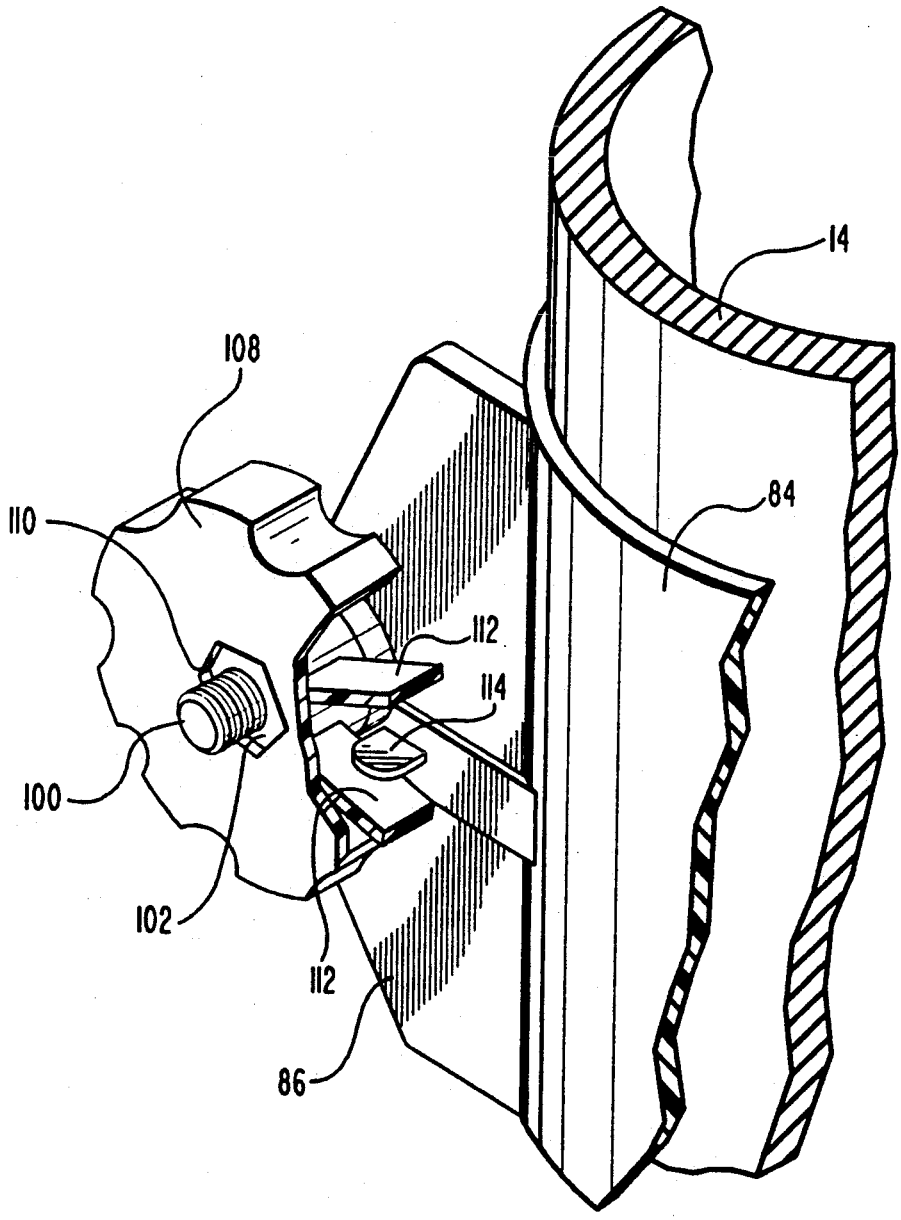
FIG. 12 is an alternative perspective view of the attachment assembly of FIG. 10, with portions cut away to more clearly illustrate features of the invention.

As illustrated in FIGS. 10 and 11, the collar 84 is configured with two bosses 116 between which is mounted a bubble level 118. The bosses 116 are positioned on the collar 84 such that the bubble level 118 will indicate when the pole 14 is disposed in a vertical position. Advantageously, if the surface on which the support is used is not level, the support 10 may be positioned on the surface and adjusted such that the pole is disposed in a vertical position, as indicated by bubble level 118.

The bubble level 118 may be any of those bubble levels conventionally known in the art for indicating vertical disposition. Thus, the bosses 116 are configured to engage the ends of the bubble level 118 in mating connection. Generally, such conventional bubble levels have sides which are concave. By providing a convex configuration to the portion of bosses 116 which engage the bubble level 118, the bubble level 118 is secured between bosses 116 in a known disposition, thereby providing an accurate measure of the vertical disposition of the pole 14 to which the collar 84 is slidably attached.

Figure 3:
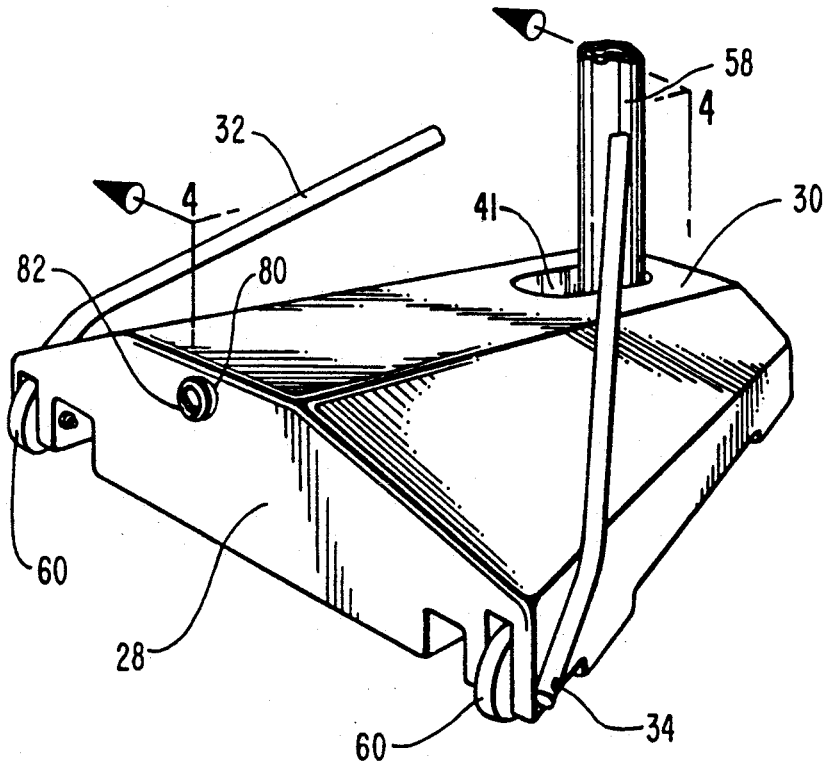
FIG. 3 is an additional perspective view of the base of the support of FIG. 1 as viewed from the distal end of the base.

Wheels 60 are attached for rotation at the distal end 28 of the base at axle 34, as best viewed in FIGS. 3 and 5. Channels 62 are provided in the base 30 to provide access to a fastener 64 on each axle 34. Wheel channels 66 are also configured in the base to provide space in the base 30 for positioning of the wheels 60. Of course, it will be appreciated by one of ordinary skill in the art that the specific configuration and attachment of the wheels 60 in the distal end 28 of the base 30 may vary according to known methods in the art.

Figure 4:
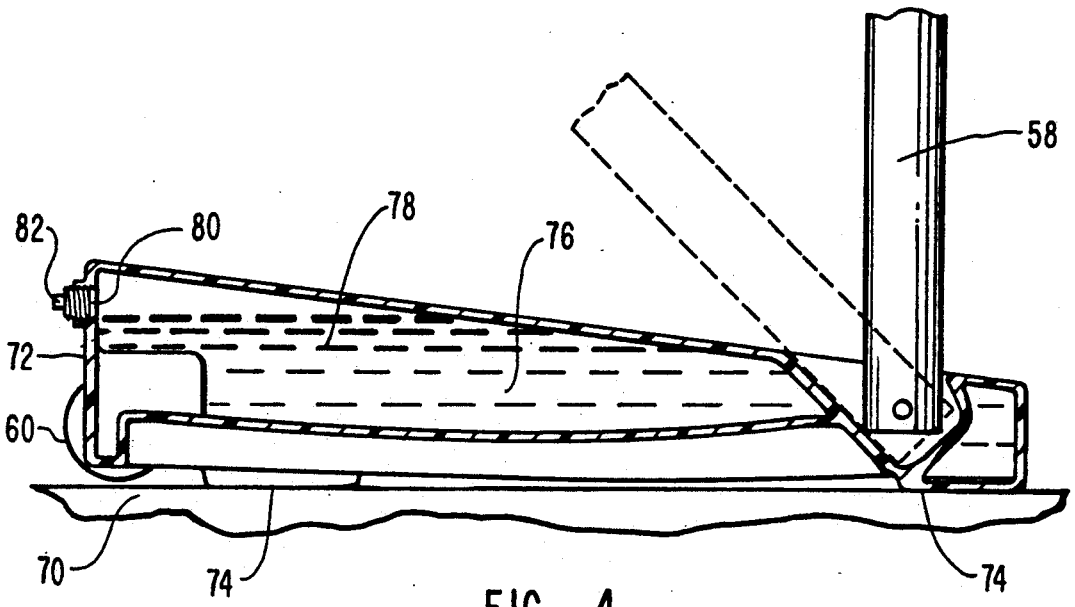
FIG. 4 is a cross-sectional view taken along line 4—4 of FIG. 3 illustrating the maximum water level attainable with this embodiment, and with phantom lines indicating the tilted position of the pole.
Figure 13:
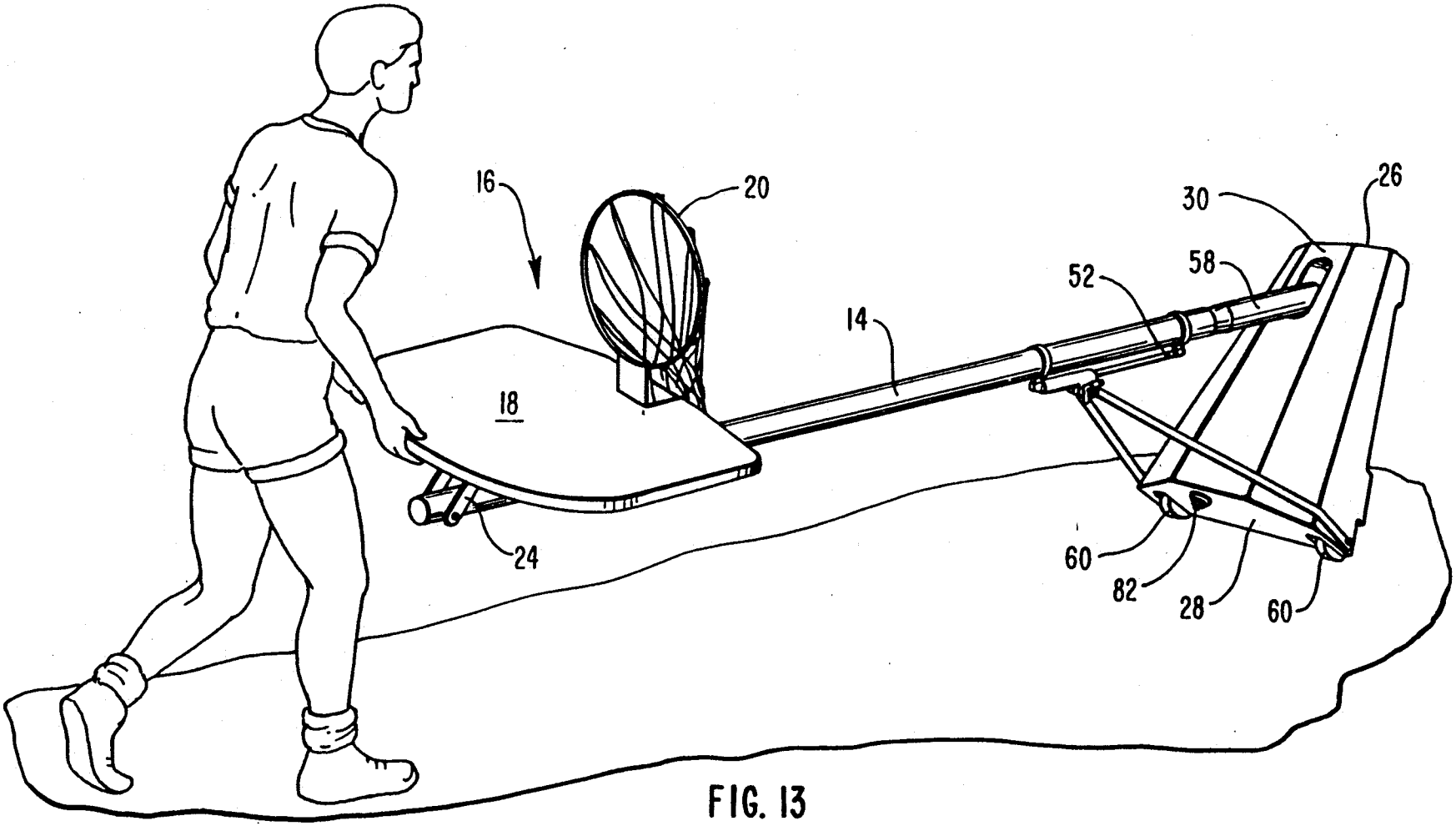
FIG. 13 is a perspective view of the embodiment of FIG. 1, with the goal system in its reclined position and illustrating how the goal system may be moved from one location to another.

As illustrated in FIG. 4, wheels 60 are preferably attached to the base 30 such that they do not provide support for the base 30 against the support surface 70 when the system is in its upright position. The wheels 60 extend outwardly from the rear 72 of the base 30 such that when the base 30 is rotated into a reclined position, such as is shown in FIG. 13, the wheels 60 will provide support against the support surface 70 and enable the goal and support system to be readily transported from one location to another.

The base includes skid plates 74 located at both the distal and proximal ends of the base 30, as viewed in FIGS. 4 and 5. Each skid plate may be configured with grooves 75 to facilitate the manufacturing of the skid plates 74. Skid plates 74 provide a frictional contact surface for the base against the support surface 70. It is presently preferred to have skid plates 74 located at least along a portion of the distal and proximal ends of the base 30, thereby providing maximum lateral stability of the base 30. The amount of surface area of the skid plates 74 may vary, although wear on the skid plates 74 may be reduced by maximizing their surface area.

When the base is filled with water, the bottom of the base will deflect towards the ground, as viewed in FIG. 4. To compensate for this deformation, the thickness of the skid plates 74 decreases towards the center of the base, as indicated in FIG. 5. This is accomplished by configuring each profile of the skid plates 74 at an angle A to the horizontal. In a presently preferred commercial embodiment of the invention, angle A is approximately two degrees. Thus, when the base is filled with water, the unique design of the skid plates 74 permits the skid plates 74 to lie flat against the support surface. Without configuring the skid plates at an angle, only the inside corner of the skid plates 74 would contact the ground, causing premature wear of the skid plates 74.

The base 30 is configured with a cavity 76 which holds a predetermined amount of water 78. The base is preferably configured such that the center of gravity of the water 78 within the cavity 76 is closer to the distal end 28 than to the proximal end 26 of the base 30. Thus, the base 30 is generally configured such that its height and width increase towards the distal end 28 of the base 30. Accordingly, the cross-sectional area of the water 78 taken perpendicular to the proximal end 26 of the base 30 is generally greater at the distal end 28 of the base 30 than at the proximal end 26 of the base 30. In a presently preferred embodiment of the invention, the base 30 is approximately eight inches high at the proximal end 26 and approximately 12½ inches high at the distal end 28. It measures approximately 41 inches from the distal end 28 to the proximal end 26 and is approximately 25 inches wide at the proximal end 26 and approximately 36½ inches wide at the distal end 28.

Although water 78 is specified herein as the substance to be utilized in filling the cavity 76 within the base 30, it will be appreciated that a variety of substances may be employed in connection with the present invention. The substance should be one that has sufficient density to provide the weight required and should preferably have some capacity to flow such that it may be introduced into or removed from the base with relative ease.

As will be pointed out in greater detail below, the unique design of the present invention permits the support and goal system to be moved without draining the water 78 out of the base 30. Thus, virtually any substance could be placed within the base 30 for use with the support system and retained within the base 30 for an extended period of time. It is presently preferred to utilize water primarily because of its ease of use and ready availability.

The base 30 includes an orifice 80 located at the rear 72 of the base 30 and providing access to the cavity 76. In a presently preferred embodiment of the invention, orifice 80 is a hole into which can be placed a plug 82 to seal the cavity 76 within the base 30. Alternatively, the orifice 80 could be threaded for engagement with the plug 82. The cavity 76 is filled with water 78 by directing it through the orifice 80.

Figure 6:
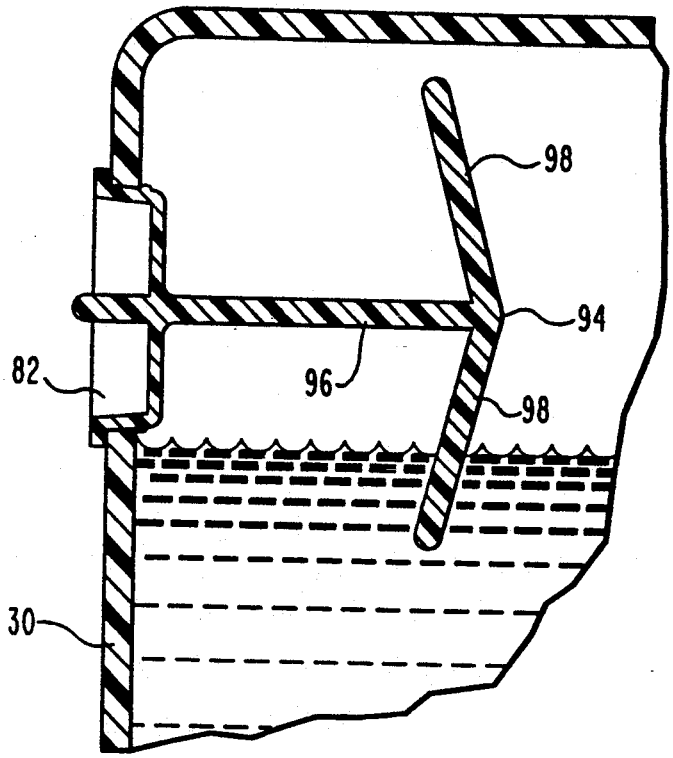
FIG. 6 is a partial sectional view of a preferred embodiment of a plug utilized in accordance with the present invention taken along line 6—6 of FIG. 5.
Figure 7:
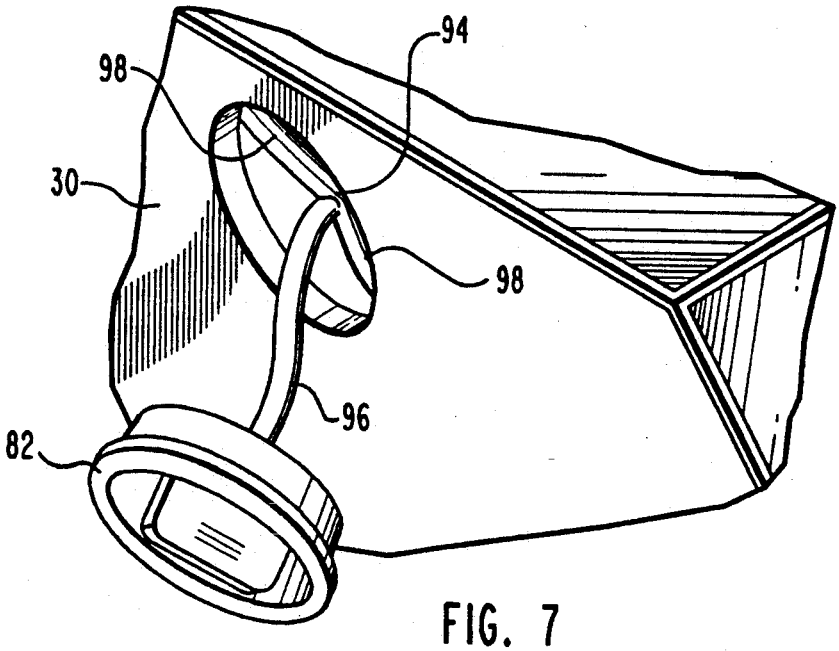
FIG. 7 is an enlarged perspective view of the plug illustrated in FIG. 6.

In a presently preferred embodiment of the invention, plug 82 is provided with an anchor 94 extending into the base 30, as illustrated in FIGS. 6 and 7. Anchor 94 is configured with a shank 96 to which are attached arms 98. The anchor 94 is configured such that the shank 96 extends outwardly from the plug 82 with the arms 98 extending radially outward from the shank 96. In a presently preferred embodiment of the invention, the arms 98 are positioned at an acute angle to the shank 96.

The anchor 94 is preferably made of a low-density polyethylene plastic. Thus, the arms 98 are easily deformable. In a presently preferred embodiment of the invention, arms 98 are disposed at a 75 degree angle with respect to shank 96. Thus, arms 98 can easily be bent towards the shank 96 to accommodate the insertion of anchor 94 into orifice 80.

The arms 98 of anchor 94 engage the base 30 upon withdrawal of the plug 82 from the orifice 80, as seen in FIG. 7, thereby loosely connecting the plug 82 to the base 30 when the plug 82 is detached from the orifice 80. Advantageously, anchor 94 acts to prevent the plug 82 from becoming separated from the base 30 and misplaced.

Orifice 80 is preferably positioned such that when filling the cavity 76 with water 78, the water level will reach the orifice 80 at a point at which approximately 10 percent of the volume of the cavity 76 remains empty. Attempts to put any more water into the cavity 76 while the base 30 is generally horizontally disposed will result in the water 78 spilling out of the orifice 80. Thus, the strategic positioning of the orifice 80 ensures that the cavity 76 is filled no more than 90 percent of its total volume.

Leaving a void within the cavity 76 ensures room for expansion in the event water 78 within the cavity 76 freezes. Because water 78 expands as it freezes, if expansion were not accounted for, it could cause the base 30 to crack or otherwise fail. In this presently preferred embodiment of the invention, orifice 80 is positioned near the top of the rear 72 of the base, as illustrated in FIG. 4. Of course, orifice 80 could be positioned anywhere along the water level illustrated in FIG. 4, or along the water level representing approximately 90 percent of capacity in any alternate design utilized.

The size of the void left within the cavity 76 will of course vary according to the ballast material used. For example, if sand is employed, the cavity 76 could be completely filled.

Orifice 80 is preferably positioned at the distal end 28 of the base 30 to facilitate draining the water 78 from the cavity 76. With the orifice positioned at the distal end 28 of the base 30, when the support is rotated onto the wheels 60 from its upright position to its reclined position (see FIG. 13), the water 78, or other ballast material, can easily be drained from the base 30.

The orifice 80 could even be configured at the top of the base 30, although it would not then act to automatically ensure that the base 30 would not be filled above a predetermined level. Such a configuration may be effectively utilized, for example, if the ballast material within the base 30 would not freeze under the conditions in which the support would be used. Thus, if it is desired to configure the orifice 80 at the top of the base and the support is to be used with water 78 in conditions where freezing could occur separate precautions should be taken to ensure that an appropriately sized void is left in the base 30. Such precautions could include configuring a second opening located along the desired water level which could be plugged after the base 30 is filled, or some indication on the base itself of the optimal water level with instructions provided to the user not to fill the base 30 beyond the indicated level.

The operation of the portable, water-filled support can best be explained by reference to FIGS. 8 and 9. In use, the pole 14 to which a backboard and goal assembly 16 are mounted engages the pole mounting segment 58 and is positioned in the generally vertical position illustrated in FIG. 8, as indicated by bubble level 118. The pole 14 is locked in this position by securing the collar 84 to the pole 14 by rotating the adjustment wheel 108 to tighten nut 102 on bolt 100.

The base 30 may then be filled with a predetermined amount of water by introducing the water into the cavity through the orifice 80. It is presently preferred that the cavity 76 hold approximately 40 gallons of water having a weight of approximately 325 pounds. The plug 82 may be placed into the orifice 80 to prevent the water 78 from spilling out of the base 30.

With the base 30 filled with water 78 and the pole 14 positioned in its generally vertical position, the basketball goal system is properly set up for use in playing the game of basketball. Importantly, the pole 14 is disposed in a generally vertical position, thereby permitting conventional backboard attachment assemblies to be used with the support 10. The vast majority of backboard attachment assemblies which are commercially available necessitate a vertical surface or pole for mounting. Hence, if the pole 14 were disposed in other than a vertical position, a customized backboard attachment assembly would be required to enable mounting of the backboard and goal assembly 16 to the pole 14.

Advantageously, the support 10 of the present invention permits the backboard and goal assembly 16 to be disposed a substantial horizontal distance from the base 30 without impinging on the available floor pace behind the backboard and goal assembly 16. As viewed in FIG. 8, virtually all of the base 30 is positioned rearward of the pole 14. Consequently, the risk of injury resulting from a player jumping near the goal and landing on the base 30 is substantially reduced.

In use, the base 30, filled with a predetermined amount of water 78, supports the backboard and goal assembly 16 in a substantially rigid position. The function of the water-filled base 30 can best be explained by defining a first moment axis 90. As used herein, the "first moment axis" 90 is defined as the point on the support 10 about which the support 10 would pivot if a sufficient downward force were applied to the rim 20 to cause the basketball goal system 12 to rotate in a clockwise direction as viewed in FIG. 8. In the embodiment of the invention illustrated in FIG. 8, the first moment axis 90 is located in the vicinity of the bottom corner of the proximal end 26 of the base.

Figure 8:
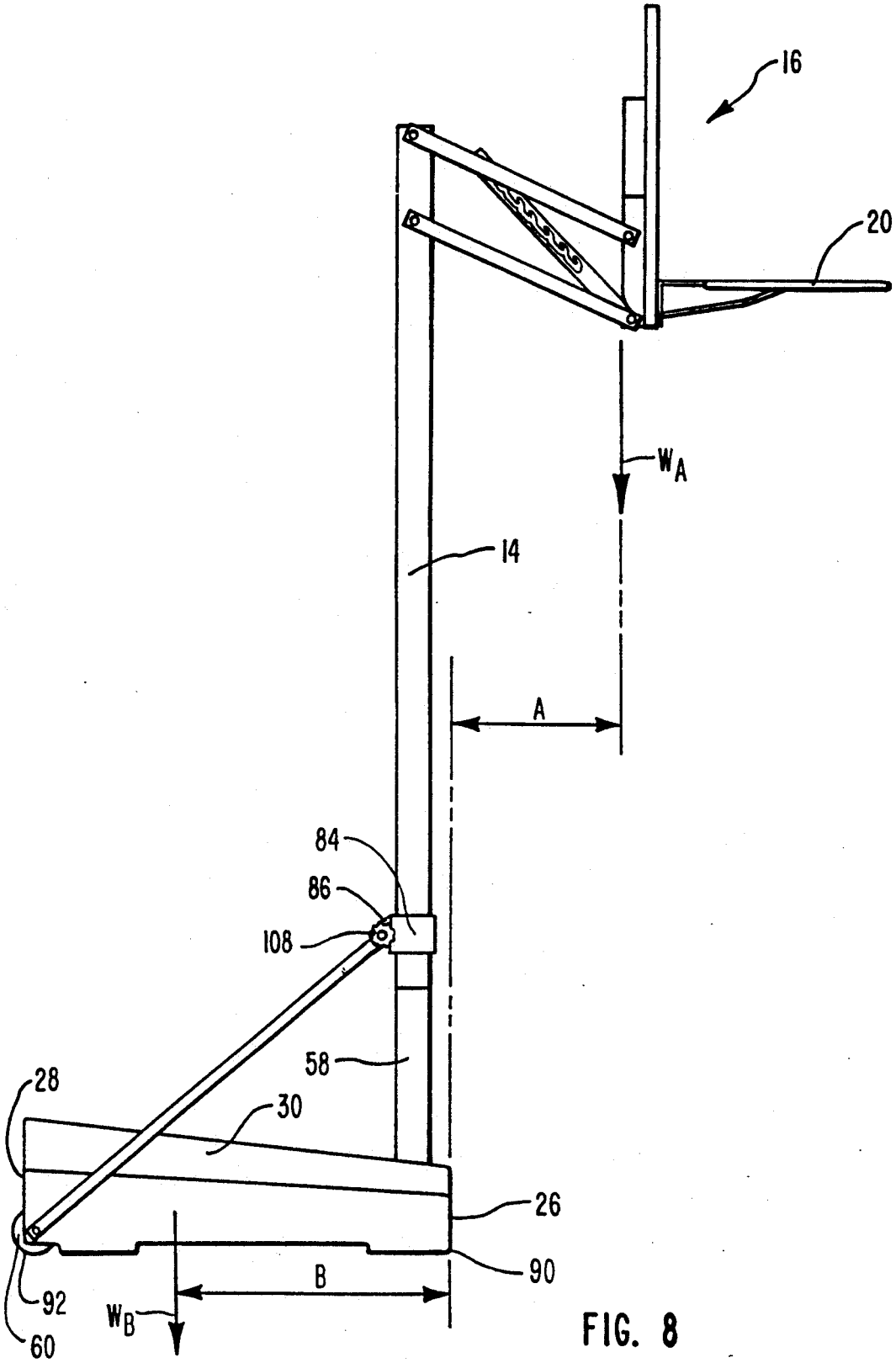
FIG. 8 is a side view of one embodiment of the present invention with the pole in its generally vertical position.

In analyzing how the support 10 maintains the backboard and goal assembly 16 in a substantially rigid position, the weight of the backboard and goal assembly 16 may be represented by a single force $W_A$ in a downward direction through the center of gravity of the backboard and goal assembly, as approximately indicated in FIG. 8. The weight of the backboard and goal assembly $W_A$ results in a first moment $M_A$ about the first moment axis 90, having a magnitude equal to the product of the weight of the backboard and goal assembly $W_A$ and the horizontal distance A between the center of gravity of the backboard and goal assembly 16 and the first moment axis 90.

In order to keep the basketball goal system supported in a vertical position, first moment $M_A$ must be counterbalanced by a second moment $M_B$. Second moment $M_B$ results from the weight of the water-filled base 30 and the pole 14 which may be represented by a single force $W_B$ in a downward direction through the center of gravity of the base 30, the location of which is approximately illustrated in FIG. 8. The magnitude of second moment $M_B$ is equal to the product of the weight $W_B$ multiplied by the horizontal distance B from the center of gravity of the water-filled base to the first moment axis 90.

As described above, the cavity 76 within the base 30 is larger towards the distal end 28 of the base. This results in the center of gravity of the water-filled base 30 being located closer to the distal end 28 of the base than to the proximal end 26 of the base, thereby increasing the length of the moment arm, distance B, and the magnitude of the second moment $M_B$ over what it would be if the base had symmetrical geometry.

Of course, the second moment $M_B$ must be of sufficient magnitude not only to prevent the backboard and goal assembly from tipping under its own weight about the first moment axis 90, but also to maintain the backboard and goal assembly 16 in a substantially rigid position when the basketball goal system is being used in playing the game of basketball.

In one presently preferred embodiment of the invention, Moment $M_B$ is generated by configuring the cavity 76 to hold approximately 40 gallons of water and configuring the base such that its center of gravity is approximately 14 inches from the distal end 28 of the base 30.

When it is desired to move the support and goal system, the adjustment wheel 108 is rotated thereby releasing the collar 84 for slidable movement with respect to the pole 14. The pole 14 is then rotated about fastener 46 from its generally vertical position to the tilted position illustrated in FIG. 9. The pole 14 is locked in this position by rotating the adjustment wheel 108 to tighten the nut 102 thereby securing the collar 84 to the pole at the desired location. In this tilted position, the user may recline the system by applying a force F to the pole 14, as illustrated in FIG. 9.

When the pole 14 is rotated about fastener 46 from its generally vertical position to its tilted position, the center of gravity of the backboard and goal assembly 16 shifts from a position in front of the base (see FIG. 8) to a position behind the proximal end of the base, as approximately illustrated by the location of $W_A$ in FIG. 9. The weight $W_A$ of the backboard and goal assembly with the pole in the tilted position creates a moment equal to the product of the weight $W_A$ and the horizontal distance C between the center of gravity of the weight $W_A$ and the second moment axis 92.

The weight $W_B$ of the water-filled base 30 also results in a moment about the second moment axis 92, but having an opposite sense as the moment resulting from the weight $W_A$ of the backboard and goal assembly 16. The magnitude of the moment about the second moment axis 92 resulting from the weight $W_B$ of the water-filled base 30 is equal to the product of the weight $W_B$ and the horizontal distance D between the center of gravity of the water-filled base and the second moment axis 92.

The moment resulting from the weight $W_B$ of the water-filled base 30 (when empty) about the second moment axis 92 should thus be greater than the moment resulting from the weight $W_A$ of the backboard and goal assembly 16 about the second moment axis 92. This ensures that the basketball goal system will be stable when in the tilted position and maintain an upright disposition, as illustrated in FIG. 9.

Thus, the force F required of the user to recline the goal system must be such that it results in a moment about the second moment axis 92 which, in addition to the moment resulting from the weight $W_A$ of the backboard and goal assembly 16, will overcome the moment resulting from the weight $W_B$ of the water-filled base about the second moment axis 92. Consequently, the force of the weight $W_A$ of the backboard and goal assembly 16 about the second moment axis with the goal in the tilted position assists the user in moving the goal system into the reclined position.

The required force F to move the goal system into the reclined position will also vary according to how high up the pole the user can reach to apply the force. The magnitude of the moment resulting from the force F varies proportionally to the length of the moment arm—the perpendicular distance between the line of direction of the force F and the second moment axis 92. As can be seen with reference to FIG. 9, the moment arm of the force F applied by the user is increased if the user is able to reach higher up the pole to apply the force F.

As the system is moved into its reclined position by rotating the base 30, the skid plates 74 are lifted off the support surface 70 and the wheels 60 come into contact with the support surface 70. In this reclined position, the system may easily be transported from one location to another as illustrated in FIG. 13.

One particularly advantageous feature of the unique portable support of the present invention is that it is not necessary to drain the water from the base in order to move the system from one location to another. Hence, the present basketball goal support system may be utilized for indoor use.

This unique feature of the present invention can be explained by defining a second moment axis 92. As used herein, the "second moment axis" 92 is defined as the point about which the support would pivot if a sufficient force were applied to the system to cause the basketball goal system to rotate in a counterclockwise direction as viewed in FIG. 9. In the embodiment of the invention illustrated in FIG. 9, the second moment axis 92 is located at the bottom corner of the distal end 28 of the base.

Significantly, the second moment axis 92 about which the system is rotated to enable it to be moved is different than the first moment axis 90 about which the system is supported for use in playing the game of basketball. The result of this unique design is that the weight of the water-filled base 30 can be positioned such that it results in a greater moment about the first moment axis 90 than about the second moment axis 92. As noted previously, the center of gravity of the water-filled base 30 is closer to the distal end 28 than to the proximal end 26 of the base 30. Hence, the moment resulting from the weight $W_B$ of the water-filled base about the first moment axis 90 is maximized to provide maximum stability to the backboard and goal assembly. Conversely, the moment resulting from the weight of the water-filled base about the second moment axis 92 is minimized, thereby decreasing the force F which must be applied by the user to tilt the goal system into the reclined position.

As seen by reference to FIG. 9, as the water-filled base is rotated about second moment axis 92, the distance D is decreased and the distance C is increased. Hence, the magnitude of the moment about the second moment axis 92 resulting from the weight $W_B$ of the water-filled base will decrease and the magnitude of the moment resulting from the weight $W_A$ of the backboard and goal assembly 16 will increase. Thus, the force F required of the user to move the goal system into its reclined position is decreased as the system is rotated.

When the goal has been moved to the desired location, the user may then discontinue force F and apply a force in the direction opposite the direction of force F to rotate the goal back into its upright position. With the goal in its upright position, the pole 14 may be rotated back into its substantially vertical position thereby enabling the system to be used in playing the game of basketball. Alternatively, the pole 14 may be left in the tilted position such as may be desired when storing the goal.

If it is desired to store the goal system, the water 78 may be drained from the base 30 by removing the plug 82 from orifice 80 and holding the base in the position illustrated in FIG. 13. With the water 78 drained from the base 30, the goal may be returned to an upright position and stored with the pole in either the tilted or vertical position. Importantly, the weight of the water in the base is not required to permit the goal system to be supported in an upright position. As pointed out previously, it is not necessary to remove the water from the base in order to move the goal. And, because the goal is designed to protect against breakage in the event water 78 within the base were to freeze, the goal may likewise be stored without draining the water 78 from the base 30.

Advantageously, the present invention greatly facilitates storage of the goal system because the total vertical height of the system with the pole 14 in its tilted position is substantially less than with the pole 14 in its vertical position, as can be seen by comparing FIGS. 8 and 9. For example, in one presently preferred embodiment of the invention, the maximum vertical height of the system with the pole in the vertical position is over 12 feet. By moving the pole to the tilted position, the vertical height may be reduced to less than 9½ feet. If an adjustable goal system, such as those disclosed and claimed in U.S. Pat. Nos. 4,781,375 and 4,805,904, is employed, the maximum vertical height could be as low as eight feet with the pole in the tilted position.

Depending on the storage facilities available for use in storing the goal system, one may elect to choose to store the goal system in a horizontal position with the wheels 60 and the top of the pole 14 supporting the system, such as would result if the system positioned as illustrated in FIG. 13 were laid down on the ground. Because the present invention is designed to permit the goal system to rotate about the rear of the support for movement, the pole 14 supports the system when it is laid on the ground. If the system were designed to rotate about the front of the support for movement, the edge of the rim 20 would have to support the upper portion of the goal system if it were laid upon the ground, thereby possibly damaging the rim.

Hence, it can be seen from the foregoing that the present invention includes a portable, water-filled support for use in supporting a basketball goal system which can be easily moved from one location to another without removing the water from the support. The invention provides such a support which is uniquely designed such that it will not break in the event the water within the support freezes. Also, the novel support system of the present invention may be used to decrease the maximum vertical height of the basketball goal system for storage purposes, thereby permitting the goal system to be stored in an upright position and facilitating storage of the system in a storage facility such as a garage or a storage shed. Additionally, the present invention provides a support to which a pole may be connected such that it is disposed in a substantially vertical position, thereby providing a vertical support to which could be attached a backboard and goal assembly.

It should be appreciated that the apparatus and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An attachment assembly for positioning a support arm to brace a pole and for regulating the movement of the pole between a first position corresponding to the pole being disposed in a generally vertical position and a second position corresponding to the pole being disposed in a tilted position at an angle to the vertical position, the attachment assembly comprising:

a contractible collar connected to the support arm in pivotal engagement and said collar being capable of slidable engagement with the pole, thereby permitting relative movement between the support arm and the pole, said collar having flanges configured for receiving a bolt;

a fastening assembly comprising a bolt and a nut threadably engageable with said bolt, said fastening assembly connectable to said collar such that tightening of said fastening assembly forces said collar to contract thereby firmly securing said collar to the pole and loosening of said fastening assembly permits said collar to expand thereby allowing said collar to slide relative to the pole such that the pole may be moved between the generally vertical position and the tilted position; and an adjustment wheel configured with a nut retainer, said nut being capable of nesting disposition within said nut retainer so that rotation of said adjustment wheel imparts rotation to said nut, said adjustment wheel being configured with a plurality of radial spokes and said collar being configured with a tab for engagement with said spokes upon rotation of said adjustment wheel whereby said adjustment wheel is biased against rotation if said tab engages one of said spokes.

2. An attachment assembly as defined in claim 1, wherein said bolt has a head and a shaft, said shaft extending through said flanges, said head of said bolt capable of nesting disposition within a bolt-head retainer configured to prevent the rotational movement of said head of said bolt relative to said collar.

3. An attachment assembly for positioning a support arm to brace a pole and for regulating the movement of the pole between a first position corresponding to the pole being disposed in a generally vertical position and a second position corresponding to the pole being disposed in a tilted position at an angle to the vertical position, the attachment assembly comprising:

a contractible collar connected to the support arm in pivotal engagement and said collar being capable of slidable engagement with the pole, thereby permitting relative movement between the support arm and the pole;

a fastening assembly connectable to said collar such that tightening of said fastening assembly forces said collar to contract thereby firmly securing said collar to the pole and loosening of said fastening assembly permits said collar to expand thereby allowing said collar to slide relative to the pole such that the pole may be moved between the generally vertical position and the tilted position; and a bubble level disposed on said collar for indicating the positioning of the pole with respect to the vertical position.

4. An attachment assembly as defined in claim 3, wherein said collar is further configured with bosses for supporting said bubble level.

5. A portable support for supporting a basketball goal system on a support surface, the basketball goal system including a pole and a backboard and goal assembly secured to a portion of the pole, the portable support comprising:

a base capable of holding a ballast material; and an attachment assembly connected to said base, said attachment assembly for regulating the movement of the pole between a generally vertical position and a tilted position disposed at an angle to the vertical position, and such that if a predetermined amount of ballast material is placed within said base, the basketball goal system will maintain a generally rigid position during use of the basketball goal system during play of the game of basketball, said attachment assembly comprising:

a support arm pivotally connected to said base;

a contractable collar pivotally connected to said support arm, said collar being capable of slidable engagement with the pole thereby permitting relative movement between the support arm and the pole, said collar having flanges configured for receiving a bolt;

a fastening assembly comprising a bolt and a nut threadably engageable with said bolt, said fastening assembly connectable to said collar such that tightening of said fastening assembly forces said collar to contract thereby firmly securing said collar to the pole and loosening of said fastening assembly permits said collar to expand thereby allowing said collar to slide relative to the pole such that the pole may be moved between said generally vertical position and said tilted position; and an adjustment wheel configured with a nut retainer, said nut being capable of nesting disposition within said nut retainer so that rotation of said adjustment wheel imparts rotation to said nut, said adjustment wheel being configured with a plurality of radial spokes and said collar being configured with a tab for engagement with said spokes upon rotation of said adjustment wheel whereby said adjustment wheel is biased against rotation if said tab engages one of said spokes.

6. A portable support for supporting a basketball goal system as defined in claim 5, wherein said bolt has a head and a shaft, said shaft extending through said flanges, said head of said bolt capable of nesting disposition within a bolt-head retainer configured to prevent the rotational movement of said head of said bolt relative to said collar.

7. A portable support for supporting a basketball goal system as defined in claim 5, further comprising a bubble level disposed on said collar for indicating the positioning o the pole with respect to the vertical position.

8. A portable support for supporting a basketball goal system as defined in claim 7, wherein said collar is further configured with two bosses for supporting said bubble level.

9. A portable support for supporting a basketball goal system as defined in claim 5, wherein said base is configured with an orifice through which said base may be filled with ballast material and said base further comprises a plug for closing said orifice.

10. A portable support for supporting a basketball goal system as defined in claim 9, wherein said plug further comprises an anchor configured to engage said base upon withdrawal of said plug out of said orifice, thereby loosely connecting said plug to said base if said plug is disengaged from said orifice.

11. A portable support for supporting a basketball goal system as defined in claim 5, wherein said base is configured with a beveled hole for restricting the movement of an end of the pole, said beveled hole including a generally vertical portion configured to restrain the pole from movement substantially beyond its generally vertical position, said beveled hole also including a tilted portion configured to restrain the pole from movement beyond a predetermined tilted position.

12. An attachment assembly for securing a support arm to a pole for movement of the support arm relative to the pole from a first position corresponding to the pole being disposed in a generally vertical position and a second position corresponding to the pole being disposed in a tilted position at an angle to the vertical position, the attachment assembly comprising:

a contractible collar pivotally connected to the support arm, said collar being capable of slidable engagement with the pole thereby permitting relative movement between the support arm and the pole, said collar including a bolt-head retainer configured to prevent the rotational movement of a head of a bolt relative to said collar, and flanges for receiving a bolt;

a bolt and a nut threadably engageable with said bolt, said bolt having a head and a shaft, said shaft extending through said flanges, said head of said bolt capable of nesting disposition within said bolt-head retainer; and an adjustment wheel configured with a nut retainer and said nut being capable of nesting disposition within said nut retainer so that rotation of said adjustment wheel imparts rotation to said nut, said adjustment wheel being further configured with a plurality of radial spokes and said collar being configured with a tab for engagement with said spokes upon rotation of said adjustment wheel whereby said adjustment wheel is biased against rotation if said tab engages one of said spokes;

said collar further configured such that rotation of said adjustment wheel to tighten said nut against said flanges forces said collar to contract thereby firmly securing said collar to the pole and such that counter-rotation of said adjustment wheel to loosen said nut against said flanges permits said collar to expand thereby allowing said collar to slide relative to the pole such that the pole may be moved between the generally vertical position and the tilted position.

13. An attachment assembly for securing a support arm to a pole as defined in claim 12, further comprising a bubble level disposed on said collar for indicating the positioning of the pole with respect to the vertical position.

14. An attachment assembly for securing a support arm to a pole as defined in claim 13, wherein said collar is further configured with bosses for supporting said bubble level.

* * * * *